United States Patent [19]

Taylor

[11] Patent Number: 4,519,377

[45] Date of Patent: May 28, 1985

[54] FIREPLACE HEAT TRANSFER APPARATUS

[76] Inventor: Thomas E. Taylor, 610 Highland Ave., Cheswick, Pa. 15204

[21] Appl. No.: 616,094

[22] Filed: Jun. 1, 1984

[51] Int. Cl.[3] ..... F24B 7/00

[52] U.S. Cl. ..... 126/121; 126/138; 126/140

[58] Field of Search ..... 126/120, 121, 123, 140, 126/201, 202, 429, 198, 200, 138, 139, 142, 146

[56] References Cited

U.S. PATENT DOCUMENTS

| | | | |
|---|---|---|---|
| 2,747,568 | 5/1956 | Dupler | 126/121 |
| 3,368,545 | 2/1968 | Ibbitson | 126/121 |
| 3,616,788 | 11/1971 | Hannebaum | 126/140 |
| 4,111,183 | 9/1978 | Haberthier | 126/429 |
| 4,282,855 | 8/1981 | Perry | 126/121 |
| 4,290,409 | 9/1981 | Mayo | 126/121 |
| 4,412,524 | 11/1983 | Ratelband | 126/121 |

FOREIGN PATENT DOCUMENTS

| | | | |
|---|---|---|---|
| 1344299 | 10/1963 | France | 126/121 |
| 808053 | 3/1957 | United Kingdom | 126/121 |

*Primary Examiner*—James C. Young

*Attorney, Agent, or Firm*—Michael R. Swartz; John R. Flanagan

[57] ABSTRACT

Fireplace heat transfer apparatus includes a main inner panel assembly adapted to be positioned across any opening to a fireplace and an auxiliary outer panel assembly pivotally mounted to the main assembly. The main assembly includes an inner transparent plate of glass and the auxiliary assembly includes an outer transparent plate of glass. The outer glass plate is thicker than the inner glass plate. The mounting relationship of the auxiliary frame to the main frame maintains the outer plate of glass in a spaced relationship to the inner plate of glass so as to define a heat transfer chamber between them. The auxiliary and main assemblies have respective frame structures which closes the chamber at its sides but provides the chamber with an open top and bottom for communicating the chamber with ambient air in the room surrounding the fireplace. By pivoting the auxiliary assembly about an axis defined across its lower end and relative to the main assembly the volume of the chamber may be changed in order to change the rate of convective thermosiphon flow of heated ambient air up through the chamber.

11 Claims, 4 Drawing Figures

FIREPLACE HEAT TRANSFER APPARATUS

BACKGROUND OF THE INVENTION

1. Field of the Invention

The present invention relates generally to the transfer of fireplace-generated heat to the surrounding ambient air outside of the fireplace and, more particularly, is concerned with a fireplace heat transfer apparatus positioned outside of the fire chamber across the fireplace entrance and which is adjustable for regulating the rate of heat transfer by adjusting thermosiphon flow of heated air within the apparatus.

2. Description of the Prior Art

Heretofore there have been many different devices proposed for transferring the heat generated by a fireplace to the surrounding ambient air in the room or area containing the fireplace. Representative examples of prior art fireplace heat transfer apparatus include those shown in U.S. Pat. Nos. 2,747,568; 3,368,545; 4,282,855; 4,290,409 and British Specification No. 808,053.

As pointed out in U.S. Pat. No. 4,282,855 to Perry, for purposes of energy conservation it is important that fireplace heat transfer apparatus conserve energy both during periods of use and nonuse. Perry discloses a fireplace screen system which uses an air blower assembly to communicate with the interior space or chamber between a pair of vertical, spaced apart glass panels for circulating air heated by the fireplace into the surrounding room area. Perry asserts that the construction of the disclosed screen system serves the desired dual conservation purposes: it provides a heat barrier and insulation barrier when the fireplace is not in use and provides a heat transfer structure when the fireplace is in use. However, it is apparent that Perry's system embodies certain potential shortcomings from the standpoint of energy conservation for it contemplates use of an energy-consuming blower to force ambient air into the fireplace and up through the chamber formed between the glass panels.

Consequently, a need still exists for a fireplace heat transfer apparatus which achieves energy conservation during periods of both use and nonuse of the fireplace and which does so in a simple, reliable manner not itself requiring the use of energy.

SUMMARY OF THE INVENTION

The present invention provides a fireplace heat transfer apparatus designed to satisfy the aforementioned needs. The hallmark of the apparatus is that it achieves energy conservation during both periods of fireplace use and nonuse by incorporation of a purely passive structure features. Like Perry, the present invention uses a heat transfer chamber formed between a pair of spaced panels, preferably transparent glass plates. However, unlike Perry, the present invention uses the energy-conserving principle of a thermosiphon to pass heated air upwardly through the apparatus chamber instead of the energy-consuming blower.

Creation of a thermosiphon in the chamber is assisted by the transparent glass plates forming the chamber having two different thicknesses. The inner glass plate nearer the fireplace entrance is thinner than the outer plate adjacent the ambient air space to be heated. Thus, heat from the fire passes by conduction through the thinner plate into the heat transfer chamber faster than heat can pass out of the chamber by conduction through the thicker outer plate. As a result, heat is entrapped in the chamber, heating and pressurizing the air therein. The pressurized, heated air rises in the chamber by convection and passes out of the chamber through a top opening which is wider than the bottom opening and can be made a variable width to regulate the flow of the heated air from the chamber. Cooler air which is located lower in the room can then enter the chamber through its bottom opening.

In summary, the different thicknesses of the glass panels and the variable width of the top opening of the chamber accelerate upward air flow creating a thermosiphon effect within and through a venture-type structure which is the width of the apparatus chamber and forces heat into the ambient air.

Accordingly, the present invention is directed to a fireplace heat transfer apparatus which comprises: (a) a main inner panel assembly supported across an opening of a fireplace so as to be heated by a fire in the fireplace to a temperature elevated above the temperature of ambient air outside of the fireplace; and (b) an auxiliary outer panel assembly supported by the inner panel assembly across the fireplace opening and spaced forwardly of the inner panel assembly so as to define a heat transfer chamber therebetween having top and bottom openings for communicating the chamber with the ambient air. The auxiliary panel assembly is movable relative to the main panel assembly between a first position in which the heat transfer chamber has a first volume supporting a first rate of convective flow of heated ambient air upwardly therethrough from the bottom opening to the top opening and a second position in which the heat transfer chamber has a second volume greater than the first volume and supporting a second rate of convective flow of heated ambient air greater than the first rate. Also, the apparatus includes means for securing the auxiliary panel assembly to the main panel assembly at any position between the first and second positions in order to adjust the size of the chamber and thereby regulate the rate of convective thermosiphon flow of heated ambient air upwardly through the heat transfer chamber.

More particularly, the main inner panel assembly includes a main frame structure adapted to be mounted across the fireplace opening and at least one inner transparent glass panel supported by the main frame structure. The auxiliary outer panel assembly includes an auxiliary frame structure pivotally mounted at its bottom end to a lower portion of the main frame structure and at least one outer transparent glass panel supported by the auxiliary frame structure. The outer glass panel of the auxiliary assembly is thicker than the inner glass panel of the main assembly. The securing means includes a generally horizontal slot defined in one of the main or auxiliary frame structures at a top portion thereof and an adjustable fastener coupled to the other of the frame structures and connectable to the one frame structure at a desired location along the slot for securing the outer panel in a desired position relative to the inner panel, thereby making possible the variable width opening at the top.

DETAILED DESCRIPTION OF THE PREFERRED EMBODIMENT

Figure 1:
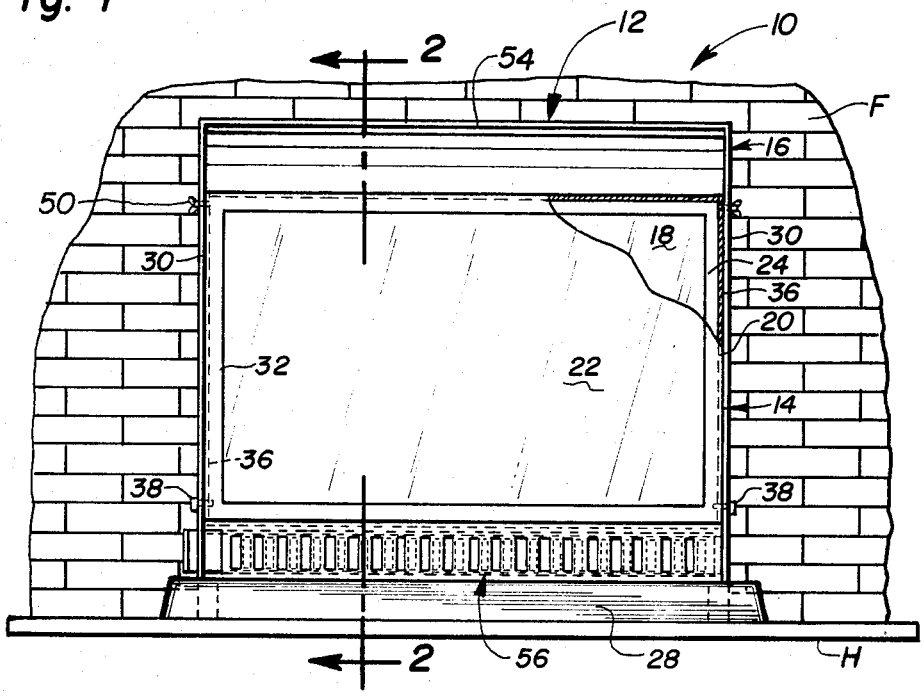
FIG. 1 is a fragmentary front elevational view of a fireplace having the fireplace heat transfer apparatus of the present invention supported across the opening of the fireplace.
Figure 2:
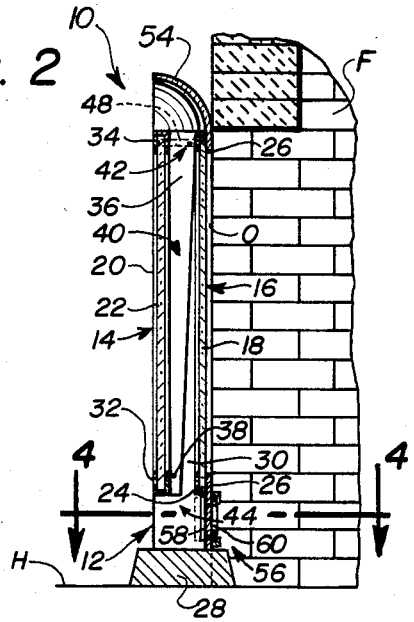
FIG. 2 is a vertical cross-sectional view of the apparatus taken along line 2—2 of FIG. 1, showing the apparatus with its heat transfer chamber being uniform in width from top to bottom and its top opening being at a minimum open width.

Referring now to the drawings, and particularly to FIGS. 1 and 2, there is shown the preferred embodiment of the fireplace heat transfer apparatus of the present invention being indicated generally by the numeral 10. The apparatus 10 includes two broad groups of parts: a main inner panel assembly 12 and an auxiliary outer panel assembly 14. The main inner panel assembly 12 is made up of a main frame structure 16 adapted to be mounted across an opening 0 of the fireplace F and an inner panel 18, preferably in the form of a transparent plate of glass of a predetermined thicknes, supported by the main frame structure. The auxiliary outer panel assembly 14 is composed of an auxiliary frame structure 20 pivotally mounted at its bottom end to a lower portion of the main frame structure 16. Also, the auxiliary assembly includes an outer panel 22, preferably in the form of another transparent plate of glass, supported by the auxiliary frame structure 20. The outer glass 22 is thicker than the inner glass panel 18.

Figure 3:
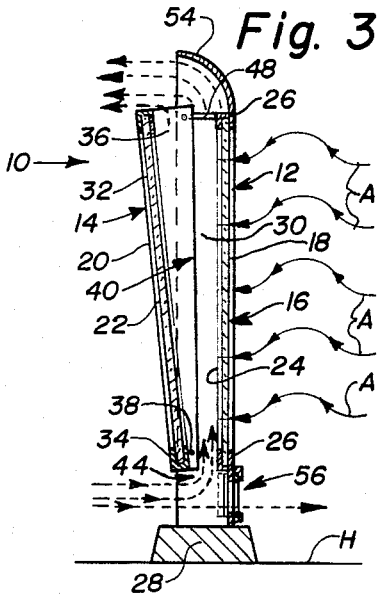
FIG. 3 is a cross-sectional view of the apparatus similar to that of FIG. 2, but showing the apparatus with its heat transfer chamber being variable in width, progressively wider going from bottom to top, and its top opening being at a maximum open width.

For mounting the inner panel 18 across the fireplace opening 0, the main frame structure 16 includes a generally rectangular inner annular-shaped frame 24 supporting the inner panel 18 about its peripheral edge 26, as seen at the top and bottom portions thereof in FIGS. 2 and 3. The inner frame 24 is supported above an elongated base 28 of the main frame structure 16 which adapts the structure 16 at its base 28 to rest on a hearth H of the fireplace F across the latter's opening 0. In such manner, the inner frame 24 is disposed generally upright across the fireplace opening and has generally vertical opposite lateral sides, a front side facing away from the fireplace F and a rear side facing toward the fireplace. In such position, the inner frame 24 places the inner panel 18 near a fire burning in the fireplace such that the inner panel 18 will be heated (as represented by wavy arrows A in FIG. 3) by the fire to a temperature elevated substantially above the temperature of ambient air outside of the fireplace F.

The main frame structure 16 also includes a pair of generally vertical side walls 30 connected along the opposite lateral sides of the inner frame 24 and extending outwardly from the front side thereof. The purpose for the presence of side walls 30 will soon become apparent.

The auxiliary frame structure 20 includes a generally rectangular outer annular-shaped frame 32 which supports the outer panel 22 about its peripheral edge 34. The outer panel 22 is generally coextensive in surface area size with the inner panel 18, but has a slightly greater glass thickness. The outer frame 32 also has opposite lateral sides and frame structure 20 further includes a pair of side walls 36 which are connected along the opposite lateral sides of the outer frame 32 and extend outwardly therefrom in the same direction toward vertical side walls 30 of the inner frame 24. These pairs of side walls 30 and 36 have a variable overlap depending on the position of auxiliary frame structure 20.

As mentioned earlier, the auxiliary frame structure 20 is pivotally mounted at its bottom end to the lower portion of the main frame structure 16. The respective side walls 30 and 36 of the main and auxiliary frame structures 16 and 20 are instrumental in the preferred embodiment in facilitating the aforementioned pivotal mounting relationship. Means in the form of a pair of pins 38 pivotally mount the auxiliary frame structure 20 at lower ends of its side walls 36 to the main frame structure 16 at lower portions of its corresponding side walls 30. Such pivotal mounting arrangement results in several important features and relationships. First, it disposes the outer frame 32 and outer panel 22 mounted therein in a generally upright and spaced relationship relative to the front side of the inner frame 24 and inner panel 18 mounted therein so as to define a heat transfer chamber, generally indicated by the numeral 40 therebetween. Second, the pivotally-connected side wall pairs 30,36 are overlapped with one another which provides the heat transfer chamber 40 with closed sides, but with an open top 42 and open bottom 44 for communicating the interior of the chamber 40 with ambient air. Third, the outer frame 32 of the auxiliary frame structure 20, in being pivotally movable toward and away from the inner frame 24 of the main frame structure 16 about a horizontal axis defined by aligned pivot pins 38, provides a way to change the volume of the space occupied by the heat transfer chamber 40 between the two frame structures 16,20. By changing the volume of chamber 40, one can change the rate of convective thermosiphon flow of heated ambient air upwardly through the chamber 40 and into the area surrounding the fireplace F. The dashed arrows at the top and bottom of the apparatus 10 in FIG. 3 represent the direction of travel of ambient air through the chamber 40. The more the auxiliary frame structure 20 is pivoted away from the main frame structure 16, the more the chamber 40 expands in volume from a generally uniform cross-sectional shape, as seen in FIG. 2, to a generally upwardly diverging cross-sectional shape, such as seen in FIG. 3.

The apparatus 10 also includes means at the upper portions of the pairs of side walls 30 and 36 of frame structures 16 and 20 for securing the auxiliary and main panel assemblies 12 and 14 in the above-described variable positions, to be described hereafter, in which the chamber 40 is completely open. This securing means takes the form of a generally horizontal elongated slot 48 defined in each of the side walls 30 of main frame structure 16 and an adjustable fastener 50 coupled to each of the side walls 36 of auxiliary frame structure 20. Each fastener 50 is connectable to corresponding side wall 30 at a desired location along the slot 48 therein so as to secure the side walls 30 and 36 together and securably maintain the assemblies 12 and 14 in a desired angular position relative to one another.

Consequently, by loosening and then tightening the adjustable fasteners 50, the auxiliary panel assembly 14 can be disposed at variable positions away from the main panel assembly 12, with the open top 42 at a minimum being equal in width to the open bottom 44. Furthermore, the auxiliary panel assembly 14 may also be positioned, as represented in solid lines in FIG. 3, so as to fully open the top 42 of the chamber 40. In the latter position of the assemblies, the volume of, and thus the rate of convective flow of heated ambient air through, the chamber 40 is greatly increased.

Figure 4:
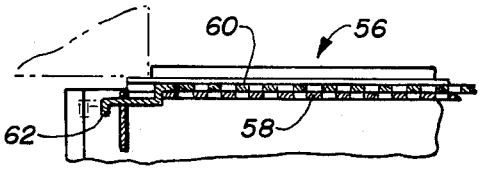
FIG. 4 is a horizontal cross-section view of the apparatus taken along line 4—4 of FIG. 2, showing the construction of the adjustable damper mechanism.

Finally, the apparatus 10 has a forwardly curved deflector 54 connected to the top of the side walls 30 and inner frame 24 of the main frame structure 16 and disposed above the top 42 of the chamber 40 for deflecting heated ambient air flowing from the open top into an outward, forward direction. Also, an adjustable damper mechanism 56, the construction of which is conventional in the art, is disposed between the base 28 and the inner frame 24 and below and adjacent to the open bottom 44 of the heat transfer chamber 40. The damper mechanism 56 has a stationary slotted panel 58 and a slidable slotted panel 60 with a lever 62 attached thereto. By use of the lever 62, the panel 60 may be moved laterally to bring the rspective sets of slots into register allowing inflow of ambient air into the fireplace F as seen in FIG. 3. Also, by sliding panel 60, the respective sets of slots may be positioned in a non-registered or closed condition, as seen in FIG. 4, which obstructs flow into the fireplace F. The damper mechanism 56 is adjusted to the latter condition during nonuse of the fireplace. In the former, registered or open condition, inflow of ambient air into the fireplace also tends to facilitate or provide a venturi flow of ambient air into the open bottom 44 of the chamber 40 during use of fireplace F.

While the inner and outer panels 18,22 have been illustrated as single plates, it is readily apparent that they could be provided in the form of pairs of doors which could be opened for resupplying fuel to the fireplace. That as well as other alternative features could be provided for such purpose, one being to attach handles to opposite sides of the main panel assembly 12 for lifting the apparatus 10 away from or to one side of the fireplace for resupplying the same with fuel.

It is thought that the fireplace heat transfer apparatus of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. Fireplace heat transfer apparatus, comprising:

(a) a main inner panel assembly supported across an opening of a fireplace so as to be heated by a fire in said fireplace to a temperature elevated above the temperature of ambient air outside of said fireplace, said main inner panel assembly including (i) a main frame structure adapted to be mounted across said fireplace opening, and (ii) at least one inner panel supported by said main frame structure across said fireplace opening, said inner panel being a first transparent plate of glass; and (b) an auxiliary outer panel assembly supported by said inner panel assembly across said fireplace opening and spaced forwardly of said inner panel assembly so as to define a heat transfer chamber therebetween having top and bottom openings for communicating said chamber with said ambient air, said auxiliary panel assembly being movable relative to said main panel assembly between a first position in which said heat transfer chamber has a first volume supporting a first rate of convective thermosiphon flow of heated ambient air upwardly therethrough from said bottom opening to said top opening and a second position in which said heat transfer chamber has a second volume greater than said first volume and supporting a second rate of convective thermosiphon flow of heated ambient air greater than said first rate, said auxiliary outer panel assembly including (i) an auxiliary frame structure pivotally mounted at its bottom end to a lower portion of said main frame structure, and (ii) at least one outer panel supported by said auxiliary frame structure adjacent said inner panel being supported by said main frame structure, said outer panel being a second transparent plate of glass and being located more remote from said inner panel of said main inner panel assembly at said top opening when said auxiliary panel assembly is disposed in said second position than when disposed in said first position, whereby said heat transfer chamber has a generally uniform cross-section when said auxiliary panel assembly is disposed in said first position and a generally upwardly diverging cross-section when said auxiliary panel assembly is disposed in said second position.

2. The fireplace heat transfer apparatus as recited in claim 1, wherein:

said first transparent plate of glass is of a first thickness; and said second transparent plate of glass is of a second thickness greater than said first thickness of said first transparent plate.

3. The fireplace heat transfer apparatus as recited in claim 1, wherein said outer panel of said auxiliary panel assembly in said first position is disposed generally upright and adjacent to said inner panel of said main panel assembly and in said second position is disposed generally more outward, inclined and remote from said inner panel than when in said first position.

4. The fireplace heat transfer apparatus as recited in claim 1, further comprising:

means for securing said auxiliary panel assembly to said main panel assembly at any position between said first and second positions in order to adjust the volume of said chamber and thereby regulate the rate of convective thermosiphon flow of heated ambient air upwardly through said heat transfer chamber.

5. Fireplace heat transfer apparatus, comprising:

(a) a main inner panel assembly supported across an opening of a fireplace so as to be heated by a fire in said fireplace to a temperature elevated above the temperature of ambient air outside of said fireplace, said main inner panel assembly including a main frame structure adapted to be mounted across said fireplace opening and at least one inner panel supported by said main frame structure, said main frame structure having (i) an elongated base adapted to rest on a hearth of said fireplace at said opening thereof, (ii) a generally rectangular inner annular-shaped frame supported above said base across said fireplace opening and mounting said inner panel, (iii) a pair of forwardly-extending side walls connected along opposite sides of said inner frame, and (iv) a forwardly curved deflector connected to said side walls and rectangular frame at the tops thereof and disposed above and adjacent to said top opening of said heat transfer chamber for deflecting heated ambient air flowing from said top opening of said heat transfer chamber into an outward, forward direction; and (b) an auxiliary outer panel assembly supported by said inner panel assembly across said fireplace opening and spaced forwardly of said inner panel assembly so as to define a heat transfer chamber therebetween having top and bottom openings for communicating said chamber with said ambient air, said auxiliary outer panel assembly including an auxiliary frame structure pivotally mounted at its bottom end to a lower portion of said main frame structure and at least one outer panel supported by said auxiliary frame structure, said auxiliary panel assembly being movable relative to said main panel assembly between a first position in which said heat transfer chamber has a first volume supporting a first rate of convective thermosiphon flow of heated ambient air upwardly therethrough from said bottom opening to said top opening and a second position in which said heat transfer chamber has a second volume greater than said first volume and supporting a second rate of convective thermosiphon flow of heated ambient air greater than said first rate.

6. The fireplace heat transfer apparatus as recited in claim 5, wherein said main frame structure further includes:

an adjustable damper mechanism disposed between said base and said rectangular inner frame and below and adjacent to said bottom opening of said heat transfer chamber, said mechanism being adjustable between an open condition which facilitates flow of ambient air into said fireplace and said bottom opening of said chamber and a closed condition which impedes flow of ambient air into said fireplace and said bottom opening of said chamber.

7. The fireplace heat transfer apparatus as recited in claim 5, wherein said auxiliary frame structure includes:

a generally rectangular outer annular-shaped frame mounting said outer panel;

a pair of rearwardly-extending side walls connected along opposite sides of said outer frame; and a pair of pins pivotally securing said side walls of said auxiliary panel assembly at lower ends thereof to said side walls of said main panel assembly at lower portions thereof such that said respective side walls located at corresponding sides of said main and auxiliary panel assemblies overlap one another when said auxiliary panel assembly is in both its first and second positions and variable positions therebetween, thereby closing opposite sides of said heat transfer chamber defined therebetween.

8. Fireplace heat transfer apparatus, comprising:

(a) a main inner panel assembly supported across an opening of a fireplace so as to be heated by a fire in said fireplace to a temperature elevated above the temperature of ambient air outside of said fireplace;

(b) an auxiliary outer panel assembly supported by said inner panel assembly across said fireplace opening and spaced forwardly of said inner panel assembly so as to define a heat transfer chamber therebetween having top and bottom openings for communicating said chamber with said ambient air, said auxiliary panel assembly being movable relative to said main panel assembly between a first position in which said heat transfer chamber has a first volume supporting a first rate of convective thermosiphon flow of heated ambient air upwardly therethrough from said bottom opening to said top opening and a second position in which said heat transfer chamber has a second volume greater than said first volume and supporting a second rate of convective thermosiphon flow of heated ambient air greater than said first rate; and (c) means for securing said auxiliary panel assembly to said main panel assembly at any position between said first and second positions in order to adjust the volume of said chamber and thereby regulate the rate of convective thermosiphon flow of heated ambient air upwardly through said heat transfer chamber, said securing means including:

(i) means defining a generally horizontal elongated slot in one of said main inner panel assembly and auxiliary outer panel assembly at a top portion thereof, and (ii) an adjustable fastener coupled to the other of said main panel assembly and auxiliary panel assembly and connectable to said one of said panel assemblies at a desired location along said slot defining means for securing said auxiliary panel assembly in a desired position relative to said main panel assembly.

9. Fireplace heat transfer apparatus, comprising:

(a) at least one inner transparent plate of glass;

(b) a main frame structure adapted to be mounted upright across an opening of a fireplace, said main frame structure including;

(i) an inner frame disposed generally upright across said fireplace opening and having generally vertical opposite lateral sides, said inner frame having a front side facing away from said fireplace and a rear side facing toward said fireplace, said inner frame mounting said inner plate of glass across said fireplace opening such that, at said rear side of said inner frame, said inner plate is heated by a fire in said fireplace to a temperature elevated above the temperature of ambient air outside of said fireplace, and (ii) a pair of generally vertical side walls connected along said opposite lateral sides of said inner frame and extending outwardly from said front side thereof;

(c) at least one outer transparent plate of glass generally coextensive in surface area size with said inner plate of glass and having a thickness greater than the thickness of said inner glass plate;

(d) an auxiliary frame structure including;

(i) an outer frame having opposite lateral sides and mounting said outer plate of glass, and (ii) a pair of side walls connected along said opposite lateral sides of said outer frame and extending outwardly therefrom in the same direction; and (e) means pivotally mounting said auxiliary frame structure at lower ends of said side walls thereof to said main frame structure at lower portions of corresponding side walls thereof such that said outer frame of said auxiliary frame structure is pivotally movable toward and away from said inner frame of said main frame structure, said corresponding side walls of said auxiliary and main frame structures are overlapped with one another, and said outer frame and outer panel mounted therein are disposed generally upright and in spaced relationship to said front side of said inner frame and inner panel mounted therein so as to define a heat transfer chamber therebetween which has closed opposite sides, as a result of said overlapped side walls, and an open top and open bottom for communicating said chamber with said ambient air and which can be changed in volume by pivotally moving said outer frame relative to said inner frame in order to change the rate of convective thermosiphon flow of heated ambient air upwardly through said chamber and into the area surrounding said fireplace.

10. The fireplace heat transfer apparatus as recited in claim 9, further comprising:

means defining a generally horizontal elongated slot in top portions of one of said side walls of said auxiliary frame structure and of said main frame structure; and adjustable fasteners coupled to the others of said side walls of said auxiliary frame structure and of said main frame structure and connectable to said ones of said side walls at a desired location along said slot defining means for securing said auxiliary frame structure in a desired pivotally spaced relationship to said main frame structure.

11. Fireplace heat transfer apparatus, comprising:

(a) a main inner panel assemly supported across an opening of a fireplace so as to be heated by a fire in said fireplace to a temperature elevated above the temperature of ambient air outside of said fireplace, said main inner panel assembly including (i) a main frame structure adapted to be mounted across said fireplace opening, and (ii) at least one inner panel supported by said main frame structure across said fireplace opening;

(b) an auxiliary outer panel assembly supported by said inner panel assembly across said fireplace opening and spaced forwardly of said inner panel assembly, said auxiliary outer panel assembly including (i) an auxiliary frame structure pivotally mounted at its bottom end to a lower portion of said main frame structure, and (ii) at least one outer panel supported by said auxiliary frame structure across said fireplace opening; and (c) said main frame structure and said inner panel of said main inner panel assembly together with said auxiliary frame structure and said outer panel of said auxiliary outer panel assembly defining a heat transfer chamber therebetween having top and bottom openings for communicating said chamber with said ambient air, said auxiliary panel assembly being movable relative to said main panel assembly between a first position in which said heat transfer chamber has a first volume supporting a first rate of convective thermosiphon flow of heated ambient air upwardly therethrough from said bottom opening to said top opening and a second position in which said heat transfer chamber has a second volume greater than said first volume and supporting a second rate of convective thermosiphon flow of heated ambient air greater than said first rate.

* * * * *